United States Patent [19]

Cohen

[11] Patent Number: 4,914,409

[45] Date of Patent: Apr. 3, 1990

[54] ELECTRIC CIRCUIT BREAKER

[75] Inventor: Vivian Cohen, Johannesburg, South Africa

[73] Assignee: Circuit Breaker Industries Limited, Elandsfontein, South Africa

[21] Appl. No.: 226,475

[22] Filed: Jul. 29, 1988

[51] Int. Cl.[4] ..... H01H 75/10

[52] U.S. Cl. ..... 335/41; 335/38

[58] Field of Search ..... 335/35–40, 335/41–42, 202, 16, 147, 95

[56] References Cited

U.S. PATENT DOCUMENTS 2,958,749 11/1960 Brackett ..... 335/36

3,278,708 10/1966 Casey et al. ..... 335/35

*Primary Examiner*—Gerald P. Tolin

*Assistant Examiner*—Lincoln Donovan

*Attorney, Agent, or Firm*—Ladas & Parry

[57] ABSTRACT

A mounting frame is provided for components of a circuit breaker. The frame is of metal and is designed so that it carries current and is not merely for supporting the components. The frame has a terminal portion, a field generating portion, pole piece defining portions, a reverse arc runner, a support post for a bi-metal strip, a latching projection for an armature, guide surfaces for the armature and a pivot pin for an operating handle. The invention further provides a circuit breaker which utilizes the frame and to a circuit breaker which uses a coil of varying resistance, in comparison with the constant resistance of a path between a terminal and a bi-metal strip, to vary the magnetic tripping characteristic of breaker.

13 Claims, 2 Drawing Sheets

ELECTRIC CIRCUIT BREAKER

This invention relates to electric circuit breakers. More particularly, it relates to magnetic tripping arrangements for, and the construction of electric circuit breakers.

According to a first aspect of the invention there is provided a mounting frame for components of a circuit breaker, which is of an electrically conducting material and includes

- a supply connection region electrically connectable to a supply cable;
- a bi-metal connecting region that is remote from the supply connection region for connection to a bi-metal element; and
- a field generating portion that is electrically between the supply connection region and the bi-metal connecting region such that, in use, current flows from the supply connection region, through the field generating portion, to the bi-metal connecting region.

The frame may define an elongate space in which the bimetal element is receivable, and the field generating portion may extend substantially parallel to the space and the supply connection region may be electrically connected to the field generating portion at an appropriate end thereof such that, use, current flow through the field generating portion and through the bi-metal element are in the same direction such that a magnetic field, generated by current flow in the field generating portion enhances a magnetic field generated by current flow in the bi-metal element. Two magnetic pole piece defining portions may be provided that are located on opposite sides of the space for the bi-metal element. At least a part of one of the pole piece defining portions may provide an electrical path between the field generating portion and the bi-metal connecting portion. In addition the frame may have at least one linking portion to provide a current flow path to the bi-metal connecting region.

The frame may also have a terminal portion to which an end of the cable may be connected, the terminal portion being mechanically and electrically connected to the supply connection region. The terminal portion may have a lip at its end, which may be curved or angular and may have a height of 0.5 mm to 1 mm.

Still further, the frame may have a bearing formation for an armature component and an arc runner portion.

This first aspect of the invention extends to a circuit breaker which includes

- a frame as described above;
- a first terminal arrangement for effecting connection of the cable to the supply connection region;
- a bi-metal element mechanically and electrically secured at one end to the bi-metal connecting region;
- a moving contact carrier electrically connected to the bimetal element at a further opposed end thereof; and
- an armature component for tripping the moving contact carrier, displaceable by the magnetic field generated, in use, by current in the bi-metal element and the field generating portion.

The bi-metal element may be elongate and may be located in the space defined therefor and extending substantially parallel to the field generating portion. The bi-metal element may be between the field generating portion and the armature component.

According to a second aspect of the invention there is provided a circuit breaker which includes

- a first terminal arrangement for connection to a cable;
- a bi-metal strip;
- a moving contact carrier electrically connected to the bi-metal strip at a first end thereof such that current flows, in use, through the bi-metal strip to generate a magnetic field;
- an armature component for tripping the moving contact carrier, displaceable by the magnetic field generated, in use, by current flow in the bi-metal strip;
- a field generating means which has a finite resistance for generating, in use, a magnetic field due to current flow therethrough, which enhances the magnetic field generated by the bi-metal strip, and which is connected electrically between the first terminal arrangement and a second end of the bi-metal strip remote from the first end thereof; and
- an electricity conducting means which has a resistance comparable to that of the field generating means and which is connected in parallel with the field generating means between the first terminal arrangement and the second end of the bi-metal strip.

It will be appreciated that the electricity conducting means of the second aspect may be part of the mounting frame referred to in regard to the first aspect of the invention. Thus, with the second aspect of the invention the first terminal arrangement is not connected directly to the bi-metal strip to provide an electric path that has as low a resistance as possible, but in such a way to provide a finite resistance so that by varying the resistance of the solenoid, more or less current can be routed through the solenoid in accordance with Kirchoff's laws, thereby easily varying the tripping characteristics of the breaker. As indicated above, the current conducting means may be provided by the frame which may be of a material having a relatively high resistivity, whereas the solenoid may be in the form of a coil (which includes a length of wire) that is of a material such as copper or aluminium that has a lower resistivity.

A clamping unit may be provided whereby an end of a supply cable may be clamped in mechanical and electrical contact against the terminal portion.

It will be appreciated that the mounting frame in accordance with the invention has portions which carry current and the frame is not merely intended for supporting components.

By means of the invention, improved circuit breakers are provided that have fewer components which may be manufactured easily and quickly and which are easier and quicker to assemble.

The invention is now described, by way of examples, with reference to the accompanying drawings, in which.

Figure 1:
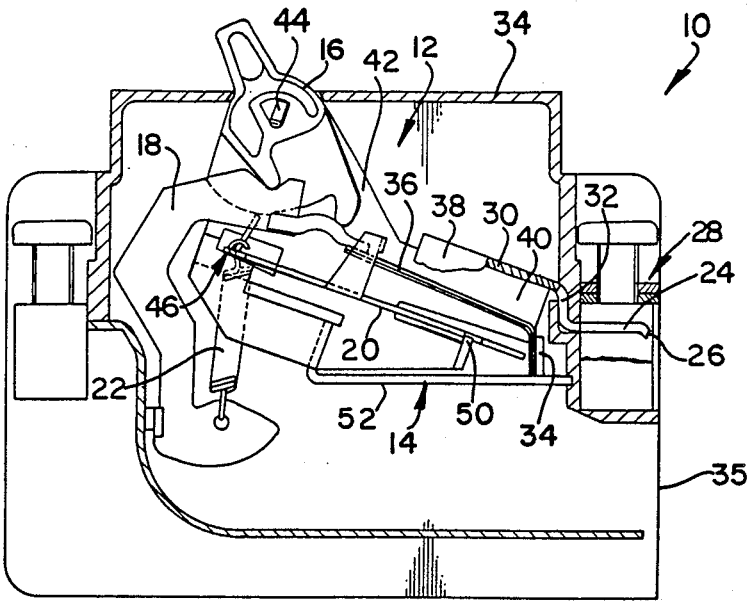
FIG. 1 shows schematically a first embodiment of a circuit breaker in accordance with the invention.
Figure 2:
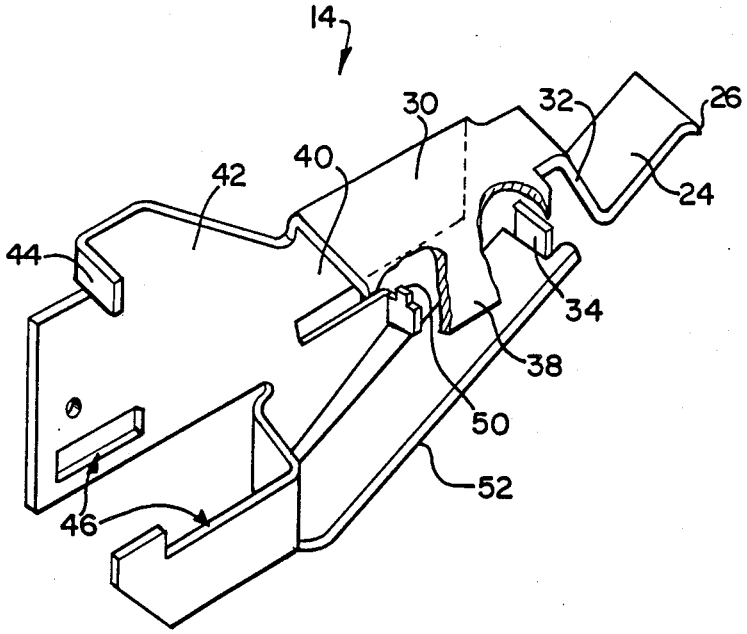
FIG. 2 shows an isometric view of a mounting frame used with the circuit breaker of FIG. 1.

Referring to FIGS. 1 and 2, a circuit breaker is designated generally by reference numeral 10. The circuit breaker 10 has a mechanism 12 with various components of the mechanism 12 being supported by a multi-purpose frame 14. Thus, the multi-purpose frame 14 pivotally supports an operating handle 16 and also carries a moving contact carrier 18 and an armature component 20. The armature component 20 and the contact carrier 18 are displaced by means of a spring 22.

The frame 14 has a terminal portion 24 that is in the form of a flat strap with a lip 26. The lip 26 has a height of 0.5 mm to 1 mm. The terminal portion 24 cooperates with a clamping arrangement 28 to clamp the end of a cable or wire in mechanical and electrical contact with the terminal portion 24, the lip 26 deforming the end of the wire or cable to mechanically lock it to the terminal portion 24. The terminal portion 24 is connected to a field generating portion 30 of the frame by means of a movement accommodating portion 32. Thus, even though the rest of the frame 14 is securely anchored in a housing 35 the terminal portion 24 is able to move relative thereto to a limited extent by virtue of the movement accommodating portion 32.

The frame 14 also has a bi-metal strip securing post 34 to which an end of a bi-metal strip 36 is secured, in a cantilever manner. As is clearly seen in FIG. 1, the field generating portion 30 is substantially parallel with the bi-metal strip 36. Depending from the field generating portion 30, on both sides thereof, about the bi-metal strip 36 are pole piece defining portions 38 and 40. The pole piece defining portion 40 is part of a base of the frame 14 that extends into a support portion 42 for the operating handle 16, a pin portion 44 at the end thereof being bent over to form a pivot pin for the operating handle 16. The frame 14 further has guide surfaces 46 for the armature component 20, a latching projection 50 and a reverse arc runner 52. The surfaces 46, the projection 50 and the pole piece defining portions 38 and 40 define an elongate space in which the armature component 20 is located.

It will be appreciated that, in use, current flows through the field generating portion 30, through part of the pole place defining portion 40, through the base portion 42, through the reverse arc runner 52, the bi-metal support post 34 and then through the bi-metal strip. Current flowing through the bi-metal strip 36 sets up a magnetic field in the pole piece defining portions 38 and 40. As current in the field generating portion 30 is in the same direction as current in the bi-metal strip 36, current in the field generating portion 30 enhances this magnetic field and thereby improves the magnetic trip characteristic of the breaker 10 in regard to what it would be if there was only current flow in the bi-metal strip 36 itself. Thus, the magnetic tripping characteristic is improved from what it would be with only the bi-metal strip, by means of the invention, without having to include a discrete coil or a discrete current carrying component, merely by using portion of the frame as a current conducting component in such a manner as to enhance the magnetic field. Further, the frame 14 is made from one piece of material that is formed to have a suitable shape and configuration and which is then bent to have the required configuration.

Figure 3:
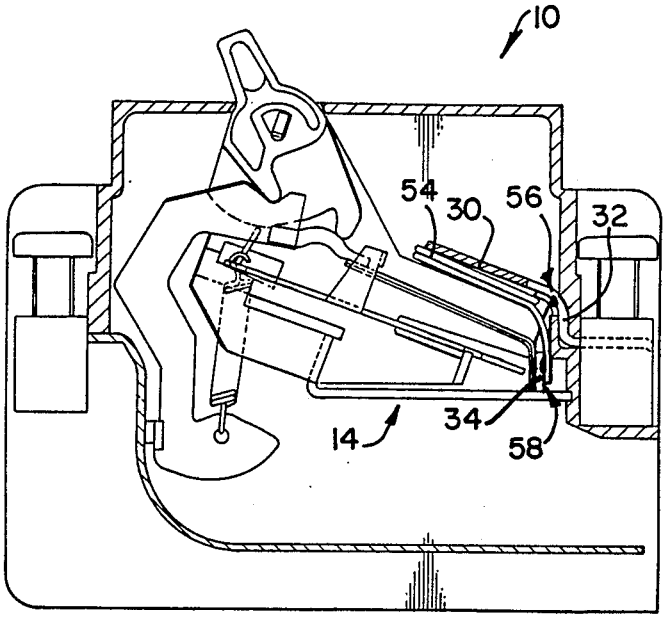
FIG. 3 shows, also schematically, a second embodiment of a circuit breaker in accordance with the invention.

It will be appreciated that there is a discrete resistance between the movement accommodating portion 32 and the bi-metal support post 34. Thus, if a coil 54 is wound around the pole piece defining portions 38 and 40, as is shown in FIG. 3, with one end of the coil being connected to the said portion 32 as is indicated at 56, with the other end of the coil being connected to the post 34 as is indicated at 58, current will also flow through the coil 54. The amount of current flowing through the coil 54 can be varied by varying the resistance of the coil 54 as compared with the path through the field generating portion 30 and the other portions of the frame 14. Thus, the field generating portion 30 operates as an electrically conducting element and the coil operates as an auxiliary electrically conducting element. Thus, by varying the resistance of the coil 54, either by varying the thickness of the wire thereof or the resistivity thereof, the tripping characteristic of the circuit breaker 10 can be varied as required.

I claim:

1. A mounting frame for components of a circuit breaker, formed from a single piece of an electrically conducting material and forming an elongate space in which a bi-metal element is receivable, said frame including:

a supply connection region electrically connectable to supply cable;

a bi-metal connecting region that is remote from the supply connection region for connection to said bi-metal element;

a field generating portion that is electrically between the supply connection region and the bi-metal connecting region wherein said field generating portion extends substantially parallel to the space and the supply connection region is electrically connected to the field generating portion at an appropriate end thereof such that in use, current flows from the supply connection region, through the field generating portion, to the bi-metal connection region said current flow through the field generating portion and through the bi-metal element being in the same direction such that a magnetic field generated by current flow in the field generating portion enhances a magnetic field generated by current flow in the bimetal element.

2. The frame claimed in claim 1, which includes two magnetic pole piece defining portions that are located on opposite sides of the space for the bi-metal element.

3. The frame claimed in claim 2, in which at least a part of one of the pole piece defining portions provides an electrical path between the solenoid portion and the bi-metal connecting portion.

4. The frame claimed in claim 1, which includes at least one linking portion that links the solenoid portion to the bimetal connecting region to provide a current flow path therebetween.

5. The frame claimed in claim 1, which includes a terminal portion to which an end of the cable may be connected, the terminal portion being mechanically and electrically connected to the supply connection region.

6. The frame claimed in claim 1, which includes a bearing formation for an armature component.

7. The frame claimed in claim 1, which includes an arc runner portion.

8. The frame claimed in claim 5, in which the terminal portion has a lip at its end.

9. A circuit breaker which includes:

a frame as claimed in claim 1;

a first terminal arrangement for effecting connection of the cable to the supply connection region;

a bi-metal element mechanically and electrically secured at one end to the bi-metal connecting region;

a moving contact carrier electrically connected to the bi-metal element at a further opposed end thereof; and an armature component for tripping the moving contact carrier, displaceable by the magnetic field generated, in use, by current in the bi-metal element and the field generating portion.

10. A circuit breaker which includes a frame as claimed in claim 1;

a first terminal arrangement for effecting connection of the cable to the supply connection region;

an elongate bi-metal element located in the space defined therefor and extending substantially parallel to the solenoid portion and being mechanically and electrically secured at one end to the bi-metal connecting region;

a moving contact carrier electrically connected to the bi-metal element at a further opposed end thereof; and an armature component for tripping the moving contact carrier, displaceable by the magnetic fields generated, in use, by current flow in the solenoid portion and the bi-metal element.

11. The circuit breaker claimed in claim 9, in which the bi-metal element is between the solenoid portion and the armature component.

12. A circuit breaker which includes a first terminal arrangement for connection to a cable;

a bi-metal strip;

a moving contact carrier electrically connected to the bi-metal strip at a first end thereof such that current flows, in use, through the bi-metal strip to generate a magnetic field;

an armature component for tripping the moving contact carrier, displaceable by the magnetic field generated, in use, by current flow in the bi-metal strip;

a first electrically conducting element which has a finite resistance for generating, in use, a magnetic field due to current flow therethrough, which enhances the magnetic field generated by the bi-metal strip, and which is connected electrically between the first terminal arrangement and a second end of the bi-metal strip remote from the first end thereof; and an auxiliary electrically conducting element which has a resistance comparable to that of the first electrically conducting element and which is connected in parallel with the first electrically conducting element between the first terminal arrangement and the second end of the bi-metal strip.

13. The circuit breaker claimed in claim 12, in which the solenoid means comprises a coil of wire.

* * * * *

UNITED STATES PATENT AND TRADEMARK OFFICE

CERTIFICATE OF CORRECTION

PATENT NO. : 4,914,409

DATED : April 3, 1990

INVENTOR(S) : Vivian COHEN

It is certified that error appears in the above-identified patent and that said Letters Patent is hereby corrected as shown below:

Column 2, line 13 "field generating means" should read -- first electrically conducting element --

Line 20 "electricity" should read -- auxiliary electrically -- and "means" should read -- element --

Lines 21-22 "field generating means" should read -- first electrically conducting element --

Line 23 "field generating means" should read -- first electrically conducting element --

Line 26 "electricity" should read -- first electrically --

Line 27 "means" should read -- element --

Lines 34 and 35 "solenoid" should read -- auxiliary conducting element --

Lines 37-38 "current conducting means" should read -- first conducting element --

Line 40 "solenoid" should read -- auxiliary conducting element --

UNITED STATES PATENT AND TRADEMARK OFFICE

CERTIFICATE OF CORRECTION

PATENT NO. : 4,914,409

DATED : April 3, 1990

INVENTOR(S) : Vivian Cohen

It is certified that error appears in the above-identified patent and that said Letters Patent is hereby corrected as shown below:

Col. 4, (claims 3 and 4) lines 42 and 45, "solenoid portion" should read --field generating portion--.

Col. 5, (claims 10 and 11) lines 9, 17 and 20, "solenoid portion should read --field generating portion--.

Col. 6, (claim 13) line 24, "solenoid means" should read --auxiliary conducting element--.

Signed and Sealed this

Third Day of March, 1992

*Attest:*

HARRY F. MANBECK, JR.

*Attesting Officer*

*Commissioner of Patents and Trademarks*